US006065299A

United States Patent [19]

Chen

[11] Patent Number: 6,065,299

[45] Date of Patent: May 23, 2000

[54] MECHANISM FREEING AN AIR CONDITIONER FROM DRIPPING

[75] Inventor: Tsai Chi Chen, Taipei, Taiwan

[73] Assignee: Yang Fan Development Co., Ltd., Taipei, Taiwan

[21] Appl. No.: 09/259,057

[22] Filed: Mar. 1, 1999

[51] Int. Cl.[7] ..... F25B 47/00

[52] U.S. Cl. ..... 62/277; 62/281

[58] Field of Search ..... 62/277, 281

[56] References Cited

U.S. PATENT DOCUMENTS

| | | | |
|---|---|---|---|
| 3,225,563 | 12/1965 | Braun | 62/277 |
| 4,513,577 | 4/1985 | Wilson et al. | 62/281 |
| 4,628,707 | 12/1986 | Katayama | 62/280 |
| 4,876,861 | 10/1989 | Tanaka et al. | 62/279 |
| 5,271,241 | 12/1993 | Kim | 62/285 |
| 5,315,836 | 5/1994 | Ressier | 62/81 |
| 5,979,172 | 11/1999 | Teller | 62/305 |

*Primary Examiner*—Henry Bennett
*Assistant Examiner*—Mark Shulman
*Attorney, Agent, or Firm*—Dougherty & Troxell

[57] ABSTRACT

A mechanism for freeing an air conditioner from dripping is provided. The mechanism mainly includes a moisture-carry assembly disposed in front of a condenser and a cooling fan of the air conditioner and having a plurality of vertically extended and adequately spaced absorbent material strips supported in a framework for collecting and carrying condensed droplets produced by an evaporator in the air conditioner. The cooling fan blows heat radiated from and surrounding the condenser toward and through the absorbent material strips to quickly dry up them, so that no condensed droplets would drip from the air conditioner.

8 Claims, 3 Drawing Sheets

MECHANISM FREEING AN AIR CONDITIONER FROM DRIPPING

BACKGROUND OF THE INVENTION

The present invention relates to a mechanism for freeing an air conditioner from dripping, and more particularly to a moisture-carry assembly provided in an air conditioner before a condenser and a cooling fan to collect and carry condensed droplets produced in the air conditioner, so that heat radiated from and surrounding the condenser can be blown by the cooling fan toward the moisture-carry assembly to quickly dry up the moisture-carry assembly.

There are air conditioners available in the market claiming that no condensed droplet would drip from the air conditioners. However, it is found only a part instead of all of the condensed droplets produced in the air conditioners and stored in a water tray is evaporated through a heater or dried by splashing it onto radiating fins by fan blades. Since the radiating fins are usually made of metal and could not absorb water, a large part of the condensed droplets splashed onto the radiating fins will still flow down from the radiating fins and be stored in the water tray. When such air conditioners are used under general conditions within limited hours, the water tray thereof is large enough to store the condensed droplets and no droplet will drip from the air conditioners, making the air conditioners looked like units do not drip condensed droplets. However, when such air conditioners are used under somewhat severe conditions, such as used in elevators that have closed space and frequently move up and down for a prolonged time, they are no longer the claimed non-dripping air conditioners because there would be too much water accumulated in the water tray and therefore overflowing therefrom. An air conditioner having condensed droplets dripped into an elevator cabinet is, of course, undesirable and would cause confusions in our daily life.

It is therefore tried by the inventor to develop a mechanism for freeing an air conditioner from dripping, so that the air conditioner may be installed in a room at a position distant away from a window, in a basement with poor ventilation, and in a closed elevator cabinet without the confusion of dripping any condensed droplet.

SUMMARY OF THE INVENTION

It is a primary object of the present invention to provide a mechanism with which condensed droplets produced in an air conditioner is conducted to a well-ventilated moisture-carry assembly and then dried by hot air blown toward the moisture-carry assembly. Thereby, no condensed droplet will drip from the air conditioner.

Another object of the present invention is to provide a mechanism for freeing an air conditioner from dripping. The mechanism includes a moisture-carry assembly that can be freely inserted into and dismounted from the air conditioner for convenient maintenance and replacement.

A further object of the present invention is to provide a mechanism for freeing an air conditioner from dripping. Therefore, the mechanism is particularly suitable for use in elevators and places that have poor ventilation and drainage but require air conditioners, such as a basement without windows, to improve the quality of our life.

DETAILED DESCRIPTION OF THE PREFERRED EMBODIMENTS

Figure 1:
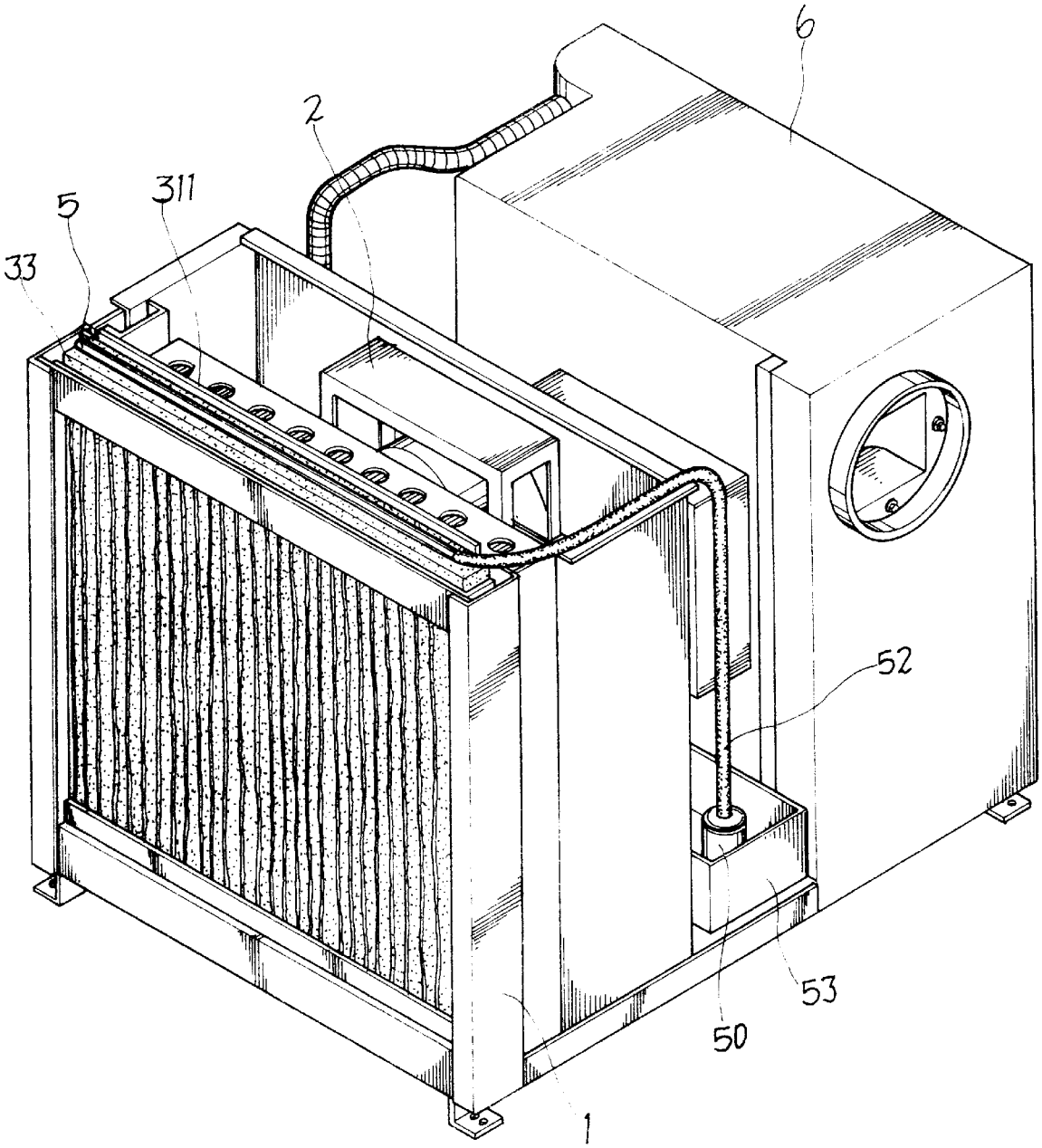
FIG. 1 is an assembled perspective showing the position of the mechanism of the present invention relative to the condenser, cooling fan, and evaporator in an air conditioner.
Figure 3:
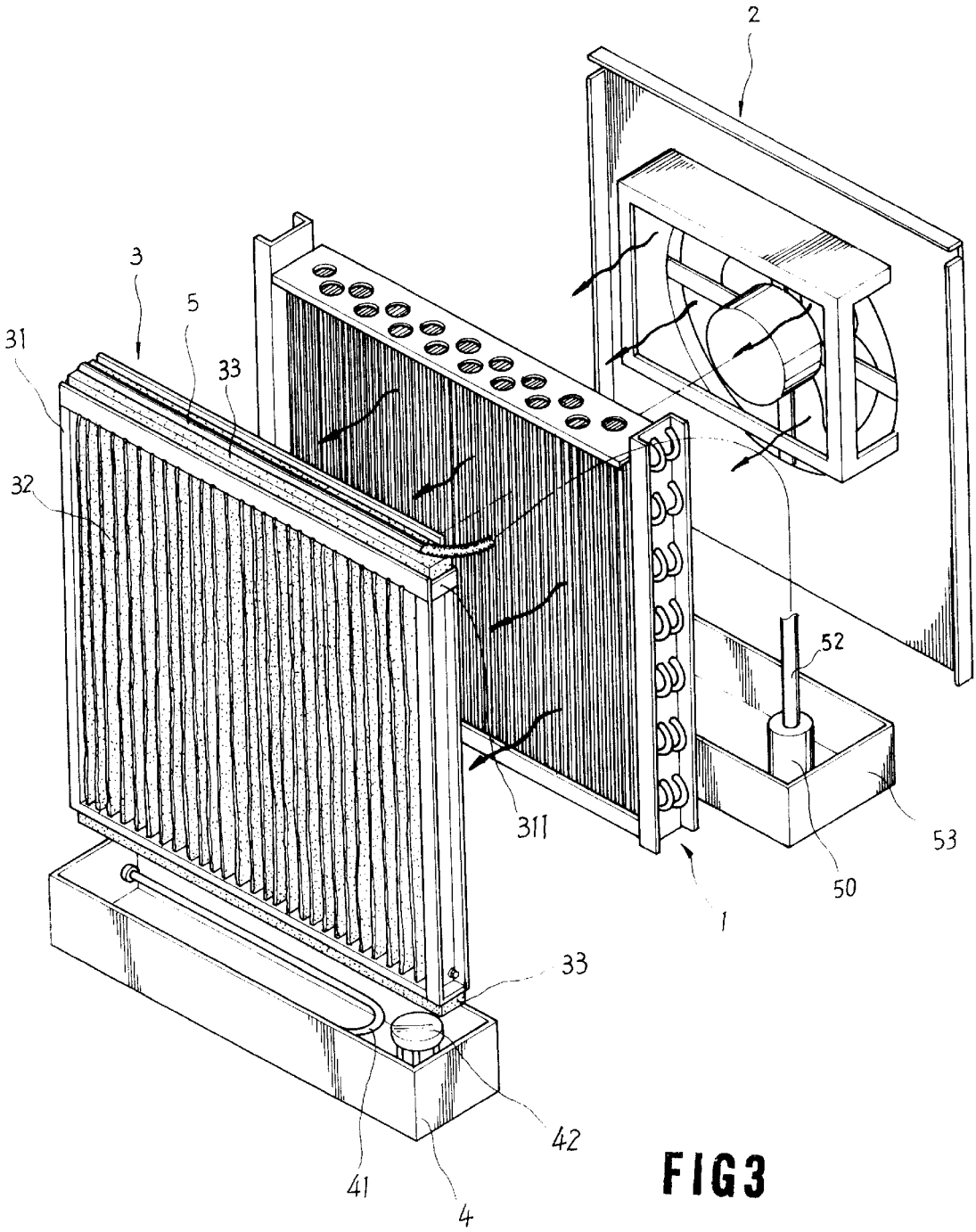
FIG. 3 is an exploded perspective showing how the mechanism of the present invention and other related components work together to dry up the moisture-carry assembly.

Please refer to FIGS. 1 and 3 that are assembled and exploded, respectively, perspective views of a mechanism according to the present invention for freeing an air conditioner from dripping. As shown, the mechanism mainly includes a moisture-carry assembly 3 that cooperates with a condenser 1, a cooling fan 2, and an evaporator 6 in the air conditioner. To particularly enhance the effect of the present invention, the condenser 1 is disposed between the cooling fan 1 and the moisture-carry assembly 3.

Figure 2:
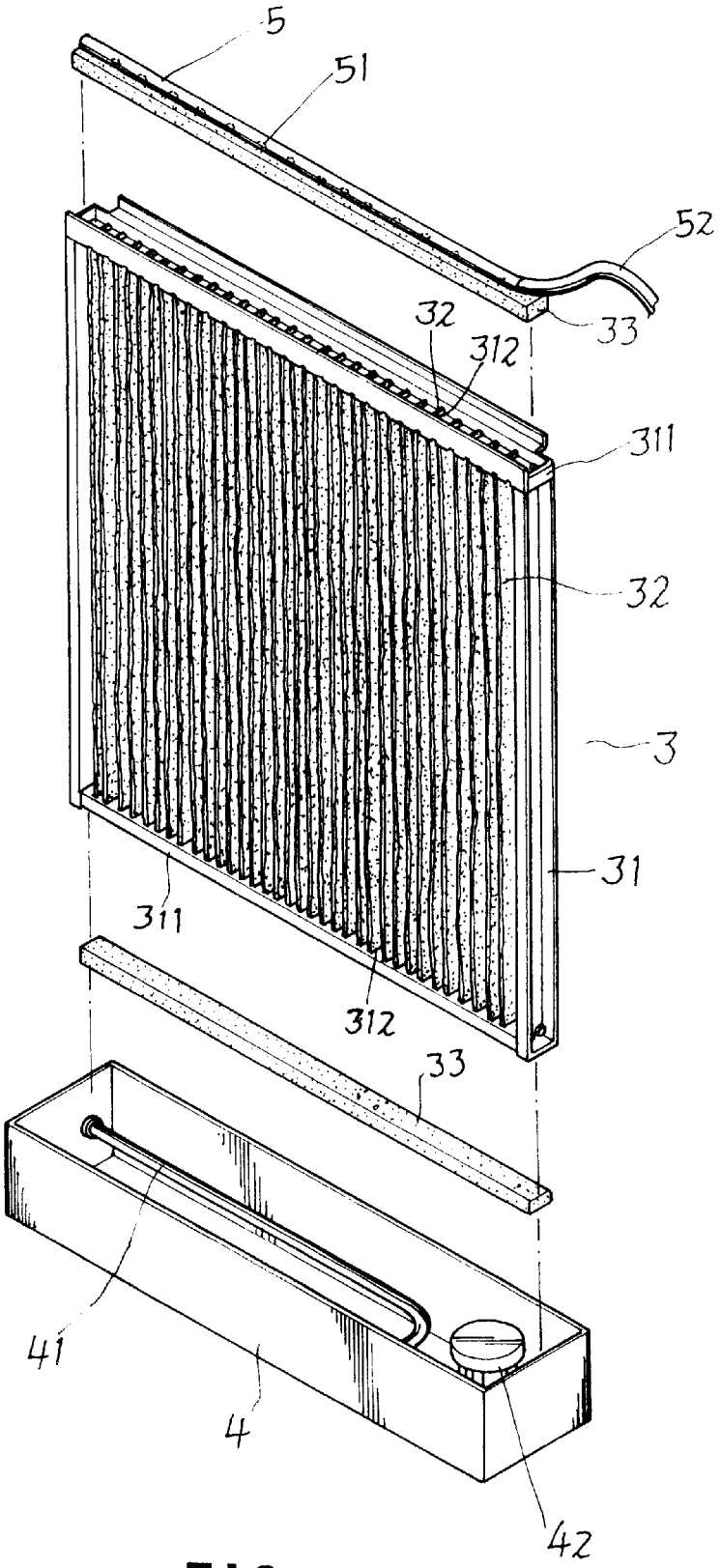
FIG. 2 is an exploded perspective of the moisture-carry assembly according to the present invention.

FIG. 2 is an exploded perspective of the moisture-carry assembly 3 that mainly includes a vertically stood hollow framework 31, a plurality of long strips of absorbent material 32, and two strips of sponges 33. Two narrow trays 311 are separately provided at top and bottom surfaces of the hollow framework 31 for accommodation of the two sponge strips 33 therein. A plurality of vertically corresponded slot pairs 312 are formed along bottom surfaces of the two narrow trays 311 at predetermined intervals, so that the absorbent material strips 32 are vertically extended between the two narrow trays 311 with their upper and lower ends received in the vertically corresponded slot pairs 312 and slightly projected from the trays 311 to contact with the two sponge strips 33 disposed in the narrow trays 311. This arrangement allows moisture contained in the sponge strips 33 to naturally permeate through the absorbent material strips 32 when the moisture contained in the sponge strips 33 is higher than that in the material strips 32. The interval between two adjacent absorbent material strips 32 is large enough for good ventilation. To facilitate convenient dismounting and replacement of the moisture-carry assembly 3 at any time, the assembly 3 is mounted in a housing of the air conditioner by removably inserting it thereinto.

An auxiliary water tray 4 is disposed below the moisture-carry assembly 3. The water tray 4 is provided therein with a heating tube 41 and a level control switch 42. When an extremely high humidity exists externally, or when the air conditioner has been used frequently or for a prolonged time, an extra amount of moisture carried by the moisture-carry assembly 3 that fails to be immediately air-dried is allowed to drop down into the water tray 4 and be temporarily stored therein.

What is to be noted is moisture permeated through and contained in the bottom sponge strip 33 could be upward transferred back to the absorbent material strips 32 via lower ends thereof due to siphon action and be air-dried. The heating tube 41 inside the water tray 4 could be turned on to serve as auxiliary means to evaporate water stored in the water tray 4. In consideration of safety in use, the turning on of the heating tube 41 depends on the level of water in the water tray 4 detected by the level control switch 42.

Moreover, a spray tube 5 having a plurality of through apertures 51 formed along it is provided above the top tray 311 of the moisture-carry assembly 3. The spray tube 5 is distantly connected to a separate water collector 53 in the air conditioner via a hose 52 detachably connected at one end to an end of the spray tube 5 and at the other end to a small pump 50 (see also FIGS. 1 and 2). Water collected in the water collector 53 could be pumped by the pump 50 into the spray tube 5 and be sprayed via the apertures 51 over the sponge strip 33 in the top tray 311.

Please refer back to FIG. 1. Condensed droplets produced by the evaporator 6 (see FIG. 1) of the air conditioner are sent to and stored in the water collector 53 via a hose extending between the evaporator 6 and the water collector 53. Then, the small pump 50 is actuated to pump water in the water collector 53 into the spray tube 5. Water in the spray tube 5 is then sprayed via the apertures 51 over the sponge strip 33 in the top tray 311 of the moisture-carry assembly 3. Due to the weight of water and the permeation action, water contained in the top sponge strip 33 is downward transferred to the absorbent material strips 32 below the top sponge strip 33. At this point, the cooling fan 2 is turned on to blow hot air surrounding the condenser 1 toward and through the absorbent material strips 32 of the moisture-carry assembly 3, as shown in FIG. 3. As a result, the hot air blown through the moisture-carry assembly 3 and the good ventilation among the absorbent material strips 32 together permit the moisture or water contained in the absorbent material strips 32 to be air-dried quickly.

In the event the air conditioner operates so frequently or the humidity in the ambient environment is so high that the hot air blown toward the absorbent material strips 32 is not sufficient to timely dry up the absorbent material strips 32, any extra moisture thereon would flow downward along the absorbent material strips 32 to the sponge strip 33 in the bottom tray 311 and then into the water tray 4 below the moisture-carry assembly 3. By storing extra water in the water tray 4, there shall be sufficient time for the water to return to the absorbent material strips 32 under siphon action and be air-dried by the hot air blown toward the absorbent material strips 32 by the cooling fan 2. Meanwhile, the heating tube 41 in the water tray 4 may be timely heated to accelerate the drying of water in the water tray 4.

In the event the heated heating tube 41 along with the hot air blown through the absorbent material strips 32 fail to prevent the level of water in the water tray 4 from quickly rising, and an unwanted high water lever is detected by the level control switch 42 in the water tray 4, an compressor in the air conditioner would be signaled via a controller (not shown) to stop operating as a safe measurement.

What is claimed is:

1. A mechanism freeing an air conditioner from dripping, comprising a structurally well-ventilated moisture-carry assembly for collecting and carrying condensed droplets produced in said air conditioner, said moisture-carry assembly being disposed in front of a condenser and a cooling fan in said air conditioner, such that said condenser is located between said moisture-carry assembly and said cooling fan; whereby when said cooling fan is turned on to rotate, heat radiated from and surrounding said condenser is blown by said cooling fan directly toward said moisture-carry assembly to quickly dry condensed droplets carried by said moisture-carry assembly.

2. A mechanism freeing an air conditioner from dripping as claimed in claim 1, wherein said moisture-carrying assembly comprises a vertically stood hollow framework, a plurality of absorbent material strips, and two sponge strips.

3. A mechanism freeing an air conditioner from dripping as claimed in claim 2, wherein said framework is provided at top and bottom surfaces with two narrow trays for separately accommodation of said two sponge strips therein.

4. A mechanism freeing an air conditioner from dripping as claimed in claim 3, wherein said two trays at top and bottom surfaces of said framework are provided along their bottom surfaces with adequately spaced and vertically corresponded slot pairs for said absorbent material strips to separately and vertically extend therebetween.

5. A mechanism freeing an air conditioner from dripping as claimed in claim 4, wherein said absorbent material strips vertically extended between said slot pairs on said top and bottom trays with upper and lower ends of said absorbent material strips slightly projected from said bottom surfaces of said top and bottom trays to contact with said sponge strips accommodated in said two trays.

6. A mechanism freeing an air conditioner from dripping as claimed in claim 1, wherein said moisture-carry assembly is mounted in a housing of said air conditioner by removably inserting it thereinto, whereby said moisture-carry assembly can be dismounted from and assembled to said housing of said air conditioner again at any time.

7. A mechanism freeing an air conditioner from dripping as claimed in claim 1, wherein said sponge strip accommodated in said top tray of said framework has a spray tube provided above it, said spray tube being formed of a plurality of apertures and being distantly connected to a water collector via a hose and a pump, whereby condensed water from an evaporator of the air conditioner being collected in said water collector can be pumped by said pump into said spray tube via said hose and sprayed over said sponge strip in said top tray.

8. A mechanism freeing an air conditioner from dripping as claimed in claim 1, wherein said sponge strip accommodated in said bottom tray of said framework downward faces a water tray disposed below said moisture-carry assembly, and said water tray having a heating tube and a level control switch provided therein.

* * * * *